US006421834B2

(12) United States Patent
Kester

(10) Patent No.: US 6,421,834 B2
(45) Date of Patent: Jul. 23, 2002

(54) SURVIVAL JACKET

(76) Inventor: Robert J. Kester, 211 Maycock St., Miners Mill, PA (US) 18705

( * ) Notice: Subject to any disclaimer, the term of this patent is extended or adjusted under 35 U.S.C. 154(b) by 0 days.

(21) Appl. No.: 09/757,010

(22) Filed: Jan. 9, 2001

Related U.S. Application Data

(60) Provisional application No. 60/175,230, filed on Jan. 10, 2000.

(51) Int. Cl.[7] ..... A41D 1/00

(52) U.S. Cl. ..... 2/94

(58) Field of Search ..... 2/89, 93–94, 85–86, 2/102, 108, 247, 69, 69.5, 44, 125, 97, 81, 82, 96; 383/4; 224/575–577

(56) References Cited

U.S. PATENT DOCUMENTS

| | | | | | |
|---|---|---|---|---|---|
| 578,691 | A | | 3/1897 | Conant | |
| 650,074 | A | | 5/1900 | Conley | |
| 1,346,320 | A | | 7/1920 | McIlaw | |
| 1,520,963 | A | | 12/1924 | Nyilas | |
| 2,165,348 | A | * | 7/1939 | Daiber | 2/94 |
| 2,248,455 | A | * | 7/1941 | Freung | 2/94 |
| 2,717,391 | A | * | 8/1955 | Bracken | 2/94 |
| 2,745,105 | A | | 5/1956 | Schaefer | |
| 4,041,549 | A | | 8/1977 | Atkinson | |
| 4,068,314 | A | | 1/1978 | Yellen et al. | |
| 4,307,470 | A | | 12/1981 | Ezell | |
| 4,389,735 | A | | 6/1983 | McLaughlin | |
| 4,467,477 | A | | 8/1984 | DeGennaro | |
| 4,502,155 | A | | 3/1985 | Itoi | |
| 4,563,777 | A | | 1/1986 | Park | |
| 4,689,831 | A | | 9/1987 | Greenberger et al. | |
| 4,862,520 | A | | 9/1989 | Gazzola | |
| 5,014,359 | A | | 5/1991 | Hanson | |
| 5,123,117 | A | * | 6/1992 | Prendergast | 2/108 |
| 5,165,111 | A | | 11/1992 | Lieberman | |
| 5,450,627 | A | * | 9/1995 | Grilliot et al. | 2/81 |
| 5,504,944 | A | * | 4/1996 | Bromer et al. | 2/269 |
| 5,526,969 | A | * | 6/1996 | Greenberger | 2/94 |
| 5,564,125 | A | | 10/1996 | Waldman et al. | |
| 5,634,579 | A | | 6/1997 | Baclawski | |
| 5,673,836 | A | * | 10/1997 | Bush | 2/94 |
| 5,699,560 | A | | 12/1997 | Greenberg | |
| 5,743,448 | A | | 4/1998 | Tsai | |
| 5,784,719 | A | | 7/1998 | Robinson | |
| 5,850,634 | A | | 12/1998 | Toombs | |
| D403,836 | S | | 1/1999 | Len | |
| 5,860,164 | A | | 1/1999 | Johnson | |
| 5,924,132 | A | | 7/1999 | Wigutow | |
| 5,927,798 | A | * | 7/1999 | Ahn | 297/129 |
| 5,987,644 | A | | 11/1999 | Mengato | |
| 5,996,121 | A | * | 12/1999 | Harris | 2/69 |

* cited by examiner

*Primary Examiner*—Gloria M. Hale
*Assistant Examiner*—Tejash Patel
(74) *Attorney, Agent, or Firm*—Clinton H. Wilkinson; Charles A. Wilkinson

(57) ABSTRACT

An interconvertible article of clothing which can be converted from a jacket form to a backpack form, the jacket having an oversized pocket concealed in the back panel of such jacket for holding a full size tent, a warning or signalling flag disposed on the tent pocket cover, a plurality of pockets on other areas of the jacket for storage of emergency blankets, first aid, and other survival necessities, and having shoulder straps and a waist belt for supporting and distributing the weight of the tent and carrying the backpack.

20 Claims, 8 Drawing Sheets

Fig. 5
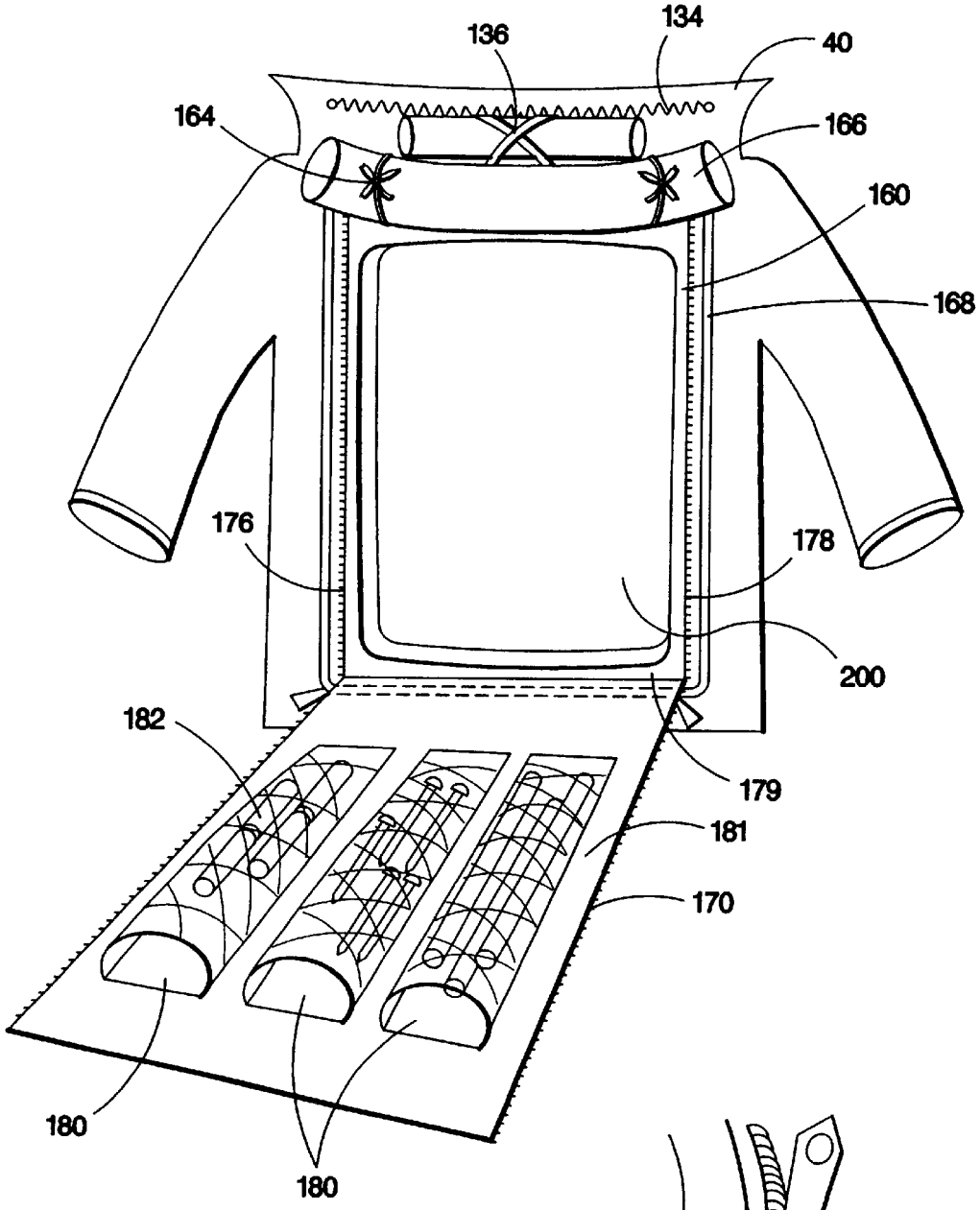
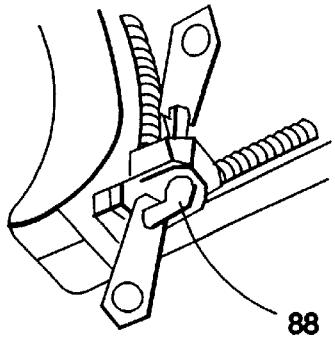
Fig. 1A

Fig. 3
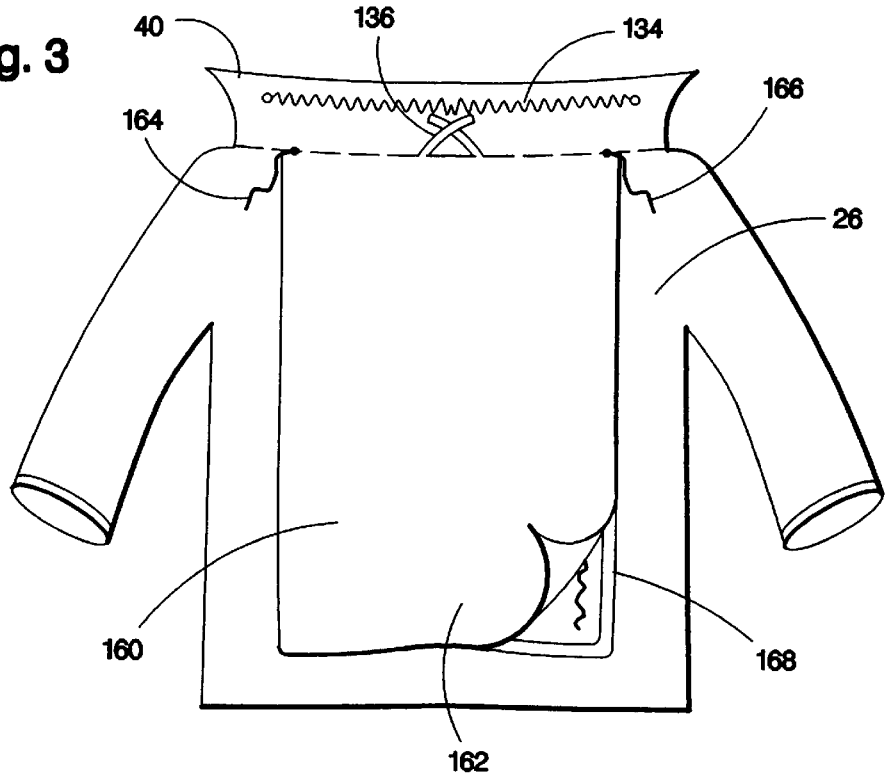
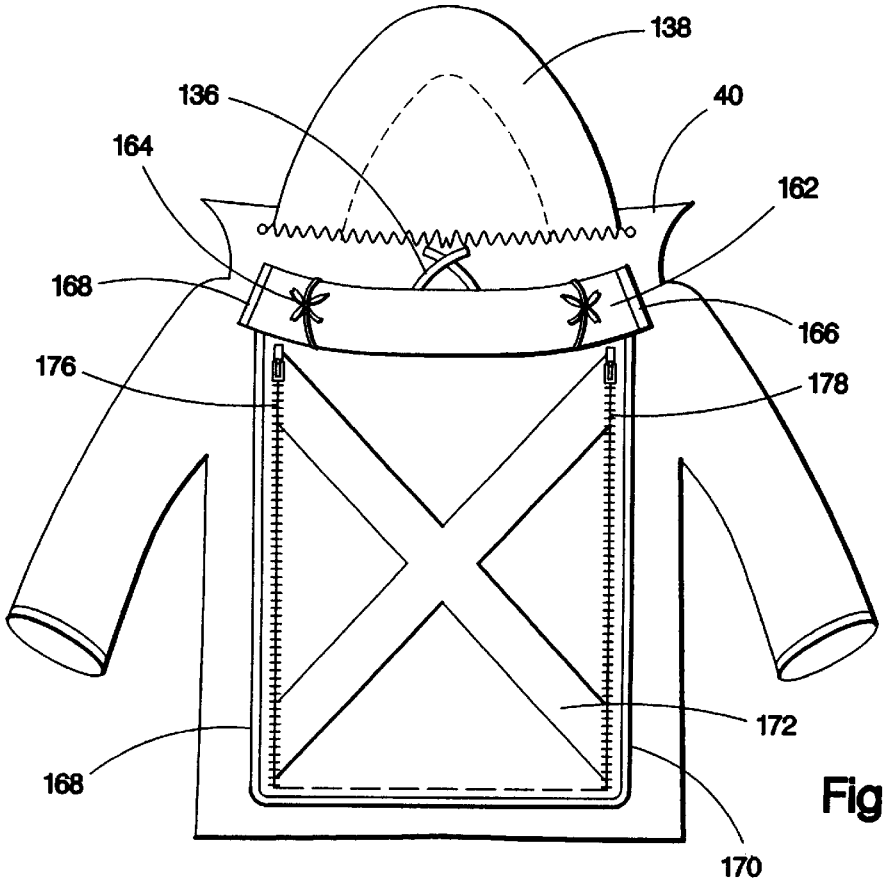
Fig. 4

Fig. 11
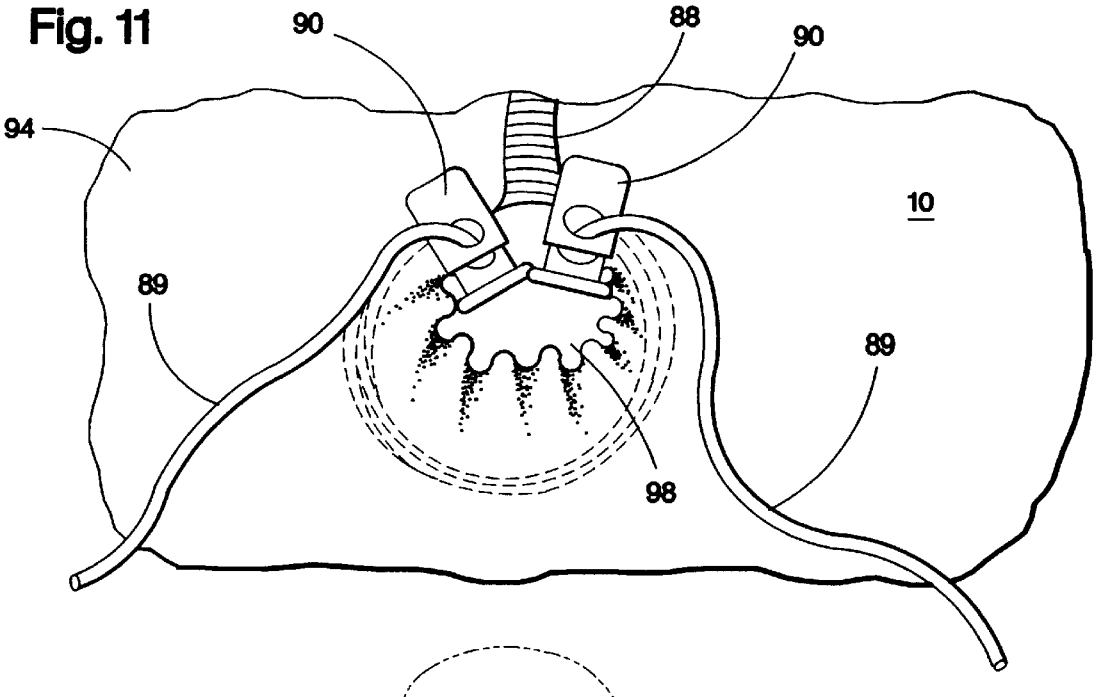
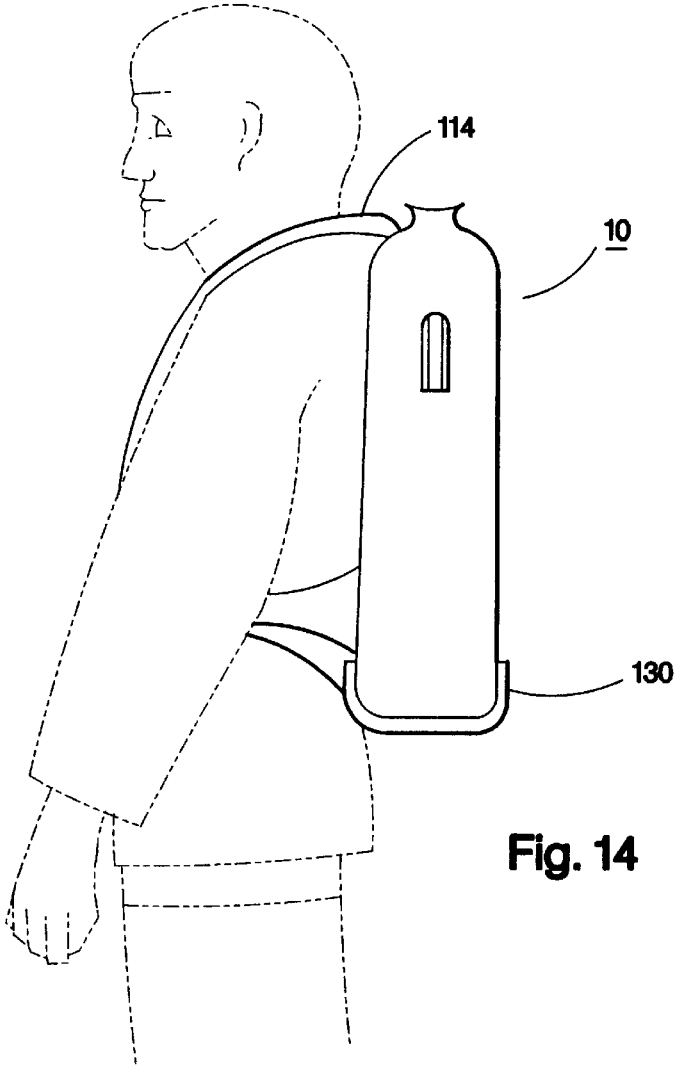
Fig. 14

SURVIVAL JACKET

PRIORITY

This application claims priority based on the provisional filing Ser. No. 60/175,230, filed on Jan. 10, 2000.

BACKGROUND OF THE INVENTION

1. Field of the Invention

The present invention relates to multi-purpose articles of clothing and article carriers, and more particularly to a sportsman or survival jacket which article can be converted into a backpack and having a special pocket in the back panel for housing and carrying a full-sized tent.

2. Preliminary Discussion

Conventional outerwear, such as an upper torso covering jacket for outdoor enthusiasts and hikers, is usually lightweight, has a wind and weather resistant outer shell, a lining to keep the user warm, and a plurality of pockets on both the inner and outer panels of the jacket mainly for carrying small articles. During any given hike, changes in temperature due to, for example, changing weather conditions or, if the hiker is climbing a mountain, changes in altitude, can occur quickly and often unexpectedly. On the one hand, if the weather is generally warm and sunny, which warm temperature may be amplified by any physical exertion involved, it may be desirable to wear a jacket in the morning hours and remove the jacket during the midday hours. However, it is inconvenient for a hiker to manually carry a jacket, as one wishes to keep his or her hands generally free during hiking. Thus, it is desirable to have a means for conveniently storing or carrying a garment without having to carry an extra backpack or pouch. On the other hand, there are also times when the weather quickly becomes colder, and a jacket is required for warmth or protection.

In other instances, such as an overnight hiking trip or even a day trip to a lake or beach, it is often desirable to bring a tent along to provide additional protection from the sun or cold when resting. However, as is well-known to outdoor enthusiasts, quickly changing weather conditions or other emergencies such as an injury from a fall or the like, may arise, which situations may be further aggravated if they occur in a remote area where the hiker may be stranded overnight or longer. In such situations, in addition to a tent it may be important to have other survival gear, such a thermal blankets, flashlights, emergency medical equipment, or other provisions. On more routine trips, while initially it may be desirable to bring a backpack to carry a lunch or the like, after such items have been removed and the backpack is essentially useless, it would be convenient if the backpack could be converted into and worn as a jacket Such interconvertibility would eliminate the need for carrying both a jacket and a backpack in many situations.

The present inventor has developed a particularly versatile article which can be either worn as a jacket, or, if desired, can be converted from jacket form into a backpack or carrying bag. In addition, while most jackets do not include a storage pocket large enough to fit a full-size tent, a special pocket is provided in the back lining of the inventor's jacket for carrying a light but essentially full size tent, including all of the poles, stakes and the like necessary to erect it. Such oversize pocket covers almost or substantially the entire area of the back panel of the jacket so that the tent can be laid neatly and compactly into the pocket without bulging or appearing awkward. The jacket also includes a reflective emergency or signaling means on the outermost side of the tent pocket cover or panel, which cover is revealed when the outer lining of the jacket is rolled up. The reflective panel may also be completely removed from the jacket to be used as an emergency flag, helicopter landing marker, or the like. The jacket also preferably provides a plurality of specially sized and constructed pockets, a pair of which are on the forearm area of the sleeves for carrying gloves, and a pair on the upper arms for carrying thermofoil blankets. This eliminates the need to carry these items in the more conventional side and front pockets of the jacket where they contribute to excess bulk and bulging of the jacket. Other special pockets for holding survival gear or other equipment may be provided. In order to help distribute the load forces exerted on the jacket when the tent is housed in the pocket or pouch on the back of the jacket, a pair of shoulder straps and a waist belt are provided attached to the pocket through the inner wall of the jacket such that the pocket is supported across substantially its entire width and height. In addition, such straps are used support the interconvertible article or clothing of the invention when used in backpack form, as shown and described in detail below.

DESCRIPTION OF RELATED ART

Many different types of multi-functional or convertible jackets have been developed over the years, both for hikers or outdoorsman who may encounter inclement weather or other emergencies, as well as for everyday use.

For example, it is well known to provide a poncho which can be adapted for use as a shelter or tent, such as in U.S. Pat. No. 578,691 issued to H. I. Conant. Conant discloses a single sheet of canvas which can be used alternatively as a poncho, blanket, knapsack and shelter tent if combined with two or more similar ponchos. See also U.S. Pat. No. 1,155,800 issued to A. H. Corbet U.S. Pat. No. 1,895,911 issued to G. C. Bosson, Jr., U.S. Pat. No. 2,344,379 issued to E. H. Wallin and U.S. Pat. No. 4,180,867 to M. I. Ridgeway, Jr. for similar disclosures. The resulting shelters in such references, however, are primitive at best, and provide only limited protection to the user from wind, rain, cold, and other elements, and are not convenient for sleeping. In addition, all such references require use of the garment itself as part of the shelter or covering. Often this may not be desirable, for example, in cold weather or other emergency situation when the jacket is the wearer's only significant protection from the elements. U.S. Pat. No. 4,594,735 issued to G. Rolf et al. discloses a combination poncho and tent wherein a supplemental tapered sleeve is attached to the poncho to form a tent. While such configuration is useful for its limited purpose, it still does not provide a complete tent structure separate from the garment. U.S. Pat. No. 4,703,521 issued to R. E. Asher et al. shows a similar garment.

Jackets having large pockets situated on the back outer panel are also known. For example, U.S. Design Pat. No. 251,936 issued to T. G. Shaw shows a jacket having a detachable pocket or pack on the back of the jacket. However, such pocket extends outwardly from the main portion of the jacket and is not concealed or protected by the outer lining of the jacket or shell as in the present invention. In addition, the Shaw pocket does not contain smaller pockets on the outer wall of the large pocket for holding tenting provisions such as tent poles and stakes. Similarly, while the garments disclosed in U.S. Pat. No. 5,195,187, U.S. Pat. No. 5,784,719 issued to L. Robinson, and U.S. Pat. No. 5,987,644 issued to Mengato, also have large capacity pockets, such pockets are also not concealed or covered by the jacket shell and would be inconvenient if not unusable for storing and carrying tenting provisions.

Numerous jacket and backpack combinations are also known in the prior art. Several references show a jacket having a knapsack or backpack attached to the back of the jacket, such as U.S. Pat. No. 4,068,315 issued to R. C. Yellen et al., which discloses a combination coat and detachable backsack supported by shoulder straps on the inner panel of the jackets. See also U.S. Pat. No. 4,068,315 issued to R. C. Yellen et al. and U.S. Pat. No. 5,784,719 issued to L. Robinson. In other references, such as U.S. Pat. No. 4,389,735 issued to R. E. McLaughlin, U.S. Pat. No. 4,689,831 issued to Greenberger et al., U.S. Pat. No. 4,563,777 issued to T. Park, and U.S. Pat. No. 5,123,117 issued to G. Prendergast, the jacket portion is foldable into a compartment in the backpack. However, unlike the present invention, such combinations include separate backpack and jacket structures, while in the present invention the jacket is essentially folded to form the backpack.

U.S Pat. No. 4,307,470 issued to S. L. Ezell, entitled "Jac Pac," discloses a jacket that can be folded up or into itself to form its own backpack. While such jacket is similar to the present inventor's jacket in that the jacket and backpack are formed from the same article or garment, the Ezell article contains straps on the outer back panel of the jacket, which straps are useless when the garment is in jacket form, are unsightly, and could be dangerous as they could become caught or snagged on some object in the environment. In the jacket of the present invention, on the other hand, the straps are located on the inside of the article in jacket form, and only when the jacket is turned inside out to be utilized as a backpack are the straps on the outside of the jacket. U.S. Design Pat. No. 403,836, issued to B. E. Len also discloses an ornamental design for a jacket which apparently can be folded in order to be carried as a backpack. However, the Len design apparently has no special means for closing the bottom of the jacket other than folding, and appears to act as a means for carrying the jacket alone while providing little or no additional storage capacity between the layers or panels of the jacket. U.S. Pat. No. 4,563,776 issued to C. J. Bossen and U.S. Pat. No. 4,862,520 issued to G. A. Gazzola also disclose coats which can be folded to be carried in the form of a carrying bag or the like. However, neither of such references is converted into a carrying bag in a manner similar to the present inventor's interconvertible article of clothing.

Despite the large amount of prior art in this area, there remains a need for a multi-purpose article or garment having a pocket which can comfortably store and carry a full-sized tent and tenting provisions, such jacket in addition having interior support straps to support and distribute the weight of the tent, and in addition which jacket can be folded or converted into a backpack for carrying items when it is not required to be worn as a jacket. In order to maximize the amount of available storage space in the jacket when converted into a pack, a special flap or bottom cover is provided which completely closes the bottom of the converted jacket. The interconvertible article of clothing of the present invention also includes a detachable brightly colored warning or distress signalling panel under the back panel of the jacket, as well as special pockets for holding tent poles and other tenting provisions. Although the present jacket is primarily designed to be worn as an outdoors, hiking, or survival jacket, due to the light weight and comfort of the jacket as well as other desirable characteristics, it is envisioned that the combination article may also be commonly worn for every day use, wherein presumably the interconvertible article would normally be used either as a jacket or carrying bag but wherein whenever a need for the alternate configuration is required, the article would then be quickly convertible for such use.

OBJECTS OF THE INVENTION

It is therefore a primary object of the invention to provide an interconvertible jacket having a weather-proof outer shell that is lightweight and can be worn in a variety of weather conditions and temperatures.

It is a further object of the invention to provide an interconvertible jacket which can be folded into and used as a backpack or article-carrying device.

It is a still further object of the invention to provide a combination jacket/backpack in a single article of clothing.

It is a still further object of the invention to provide an article having a large storage compartment located on the back panel thereof for holding a full-size tent and all accompanying tenting provisions.

It is a still further object of the invention to provide a garment having backpack straps and belt attached to the interior side of the back of the garment to support the tent the when the article of clothing of the present invention is worn as a jacket and to support the backpack when converted into and worn as a backpack.

It is a still further object of the invention to provide a detachable reflective signal on the back of the jacket which is located on the outer portion of the large storage pocket on the back of the jacket and is visible when the back outer panel is rolled up.

It is a still further object of the invention to provide a jacket having special pockets on the inner side of the cover for the large storage compartment or pocket for storing tenting poles and the like.

It is a still further object of the invention to provide a jacket having a series of pockets for holding survival gear and the like.

It is a still further object of the invention to provide a garment having a weather resistant watch secured to one sleeve of the garment and a weather resistant compass secured to the other sleeve of the garment.

It is a still further object of the invention to provide a jacket having pockets located in the forearms of the garment for holding or storing a pair of gloves, which gloves are detachably secured to the jacket by a strap.

Still other objects and advantages of the invention will become clear upon review of the following detailed description in conjunction with the appended drawings.

SUMMARY OF THE INVENTION

The present invention provides a combination jacket/backpack which allows users to easily carry and conceal many of the items which are necessary to survive in the outdoors or wilderness, as well as a versatile article of clothing that can also be used for everyday use. In the preferred embodiment, positioned centrally and covering substantially the back panel of the jacket is a large pocket used to store a full sized tent. The pocket is covered or concealed by the outer shell of the jacket, which shell can be rolled up and secured around the shoulder area of the jacket. Situated under the outer panel is a detachable second panel or pocket cover having a phosphorescent or reflective coating on one side, which acts as the front panel of the tent pocket as well as a signaling device to increase the visibility of the wearer in the dark. In addition, since the weight of the tent on the back of the jacket would normally tend to strain or distort the jacket in such area, in order to more evenly distribute the load forces on the jacket a pair of adjustable shoulder straps as well as a waist belt are provided on the inner side of the back panel. The jacket also contains a plurality of pockets on the front and back sections for holding other survival necessities, such as gloves, a thermofoil blanket, and the like.

While the present article can be worn as a jacket with or without the tent, the garment can also be converted from jacket form into a backpack, wherein the panels of the jacket are converted to act as the backpack enclosure. To convert the article from jacket form to backpack form, first the sleeves of the jacket are folded rearwardly across the back panel. Next, the front panels are folded rearwardly on top of the sleeves and are held together by a reversible zipper closure. The bottom of the jacket is then secured, first by fully tightening the adjustable drawstring or cord around the lower periphery of the jacket using cord locks or clamps provided on the drawstring, which clamps are also used to adjust the comfort of the jacket in jacket form. After the drawstring is fastened, a rubber coated flap or panel is secured over the bottom portion of the jacket, forming the final closure of the backpack. Since in converting the jacket into backpack form the jacket has been turned inside out, the waist belt and shoulder straps are now situated on the outer surface of the converted backpack, which straps and waist belt can now be used to carry the pack in the normal manner. Articles to be stored in the backpack are inserted through what was the neck and shoulder area of the jacket, which can also be secured by a drawstring. In such manner, a backpack having a larger amount of storage space than in most prior art combination garment/backpacks is provided. In converting the article from backpack form to jacket form, the above procedure is essentially carried out in reverse order.

BRIEF DESCRIPTION OF THE DRAWINGS

FIG. 1A is a detail of the double zipper used to secure the front panels of the interconvertible jacket of the invention.

FIG. 3 is a back view of the combination jacket of the preferred embodiment of the invention with one corner of the back panel slightly raised.

FIG. 4 is a back view of the combination jacket with the outer lining of the jacket rolled up to reveal the reflective panel situated underneath.

FIG. 5 is a back view of the combination jacket with the reflective panel unzipped to illustrate the pocket and tenting provisions stored within.

FIG. 7 is a front view of the reflective panel separated from the jacket to be used as an emergency marker, flag or the like.

FIG. 11 is a close-up view of the bottom of the jacket as shown in FIG. 10.

FIG. 14 is side view of the article of interconvertible clothing of the invention being worn in backpack form.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
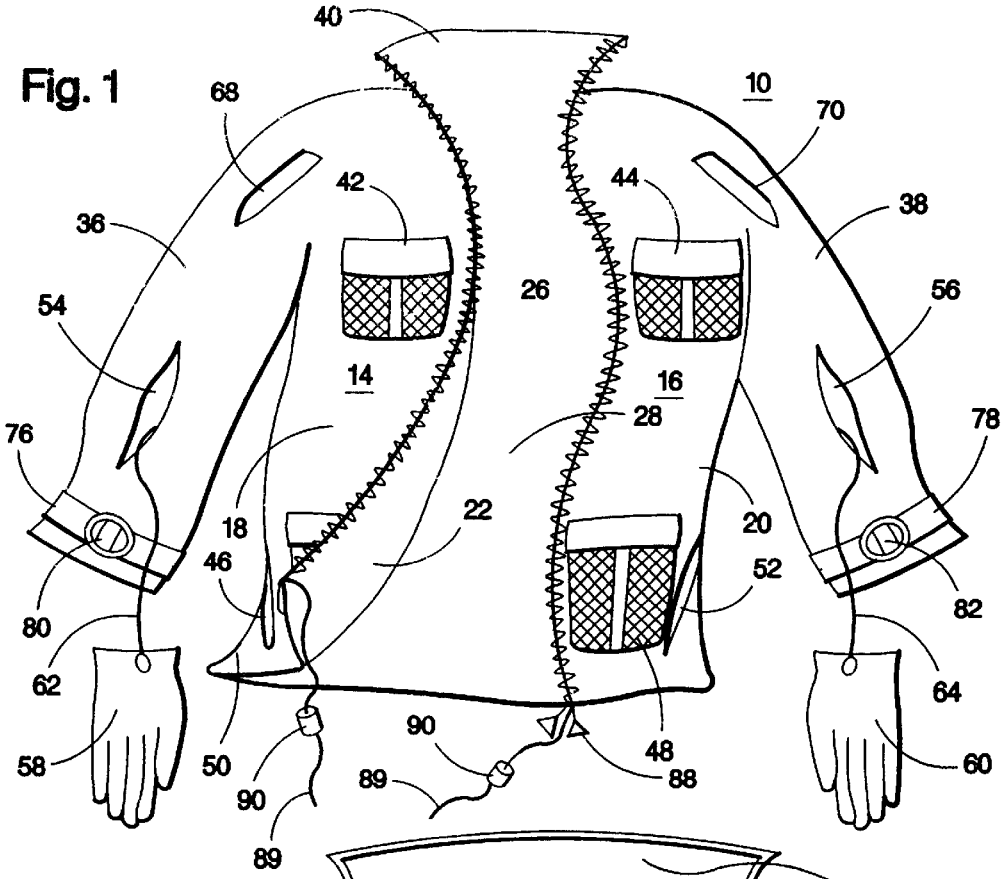
FIG. 1 is a front view of a preferred embodiment of the combination jacket of the invention.
Figure 2:
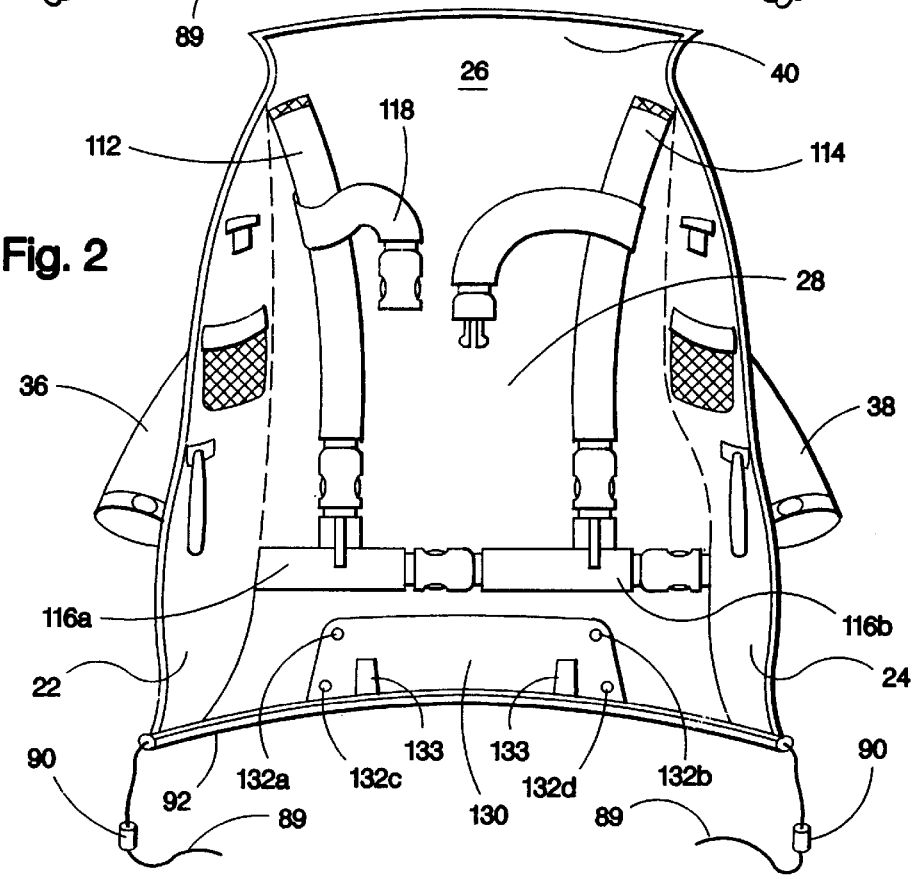
FIG. 2 is another front view of the combination jacket shown with the front panels in an opened position revealing the backpack support straps.
Figure 6:
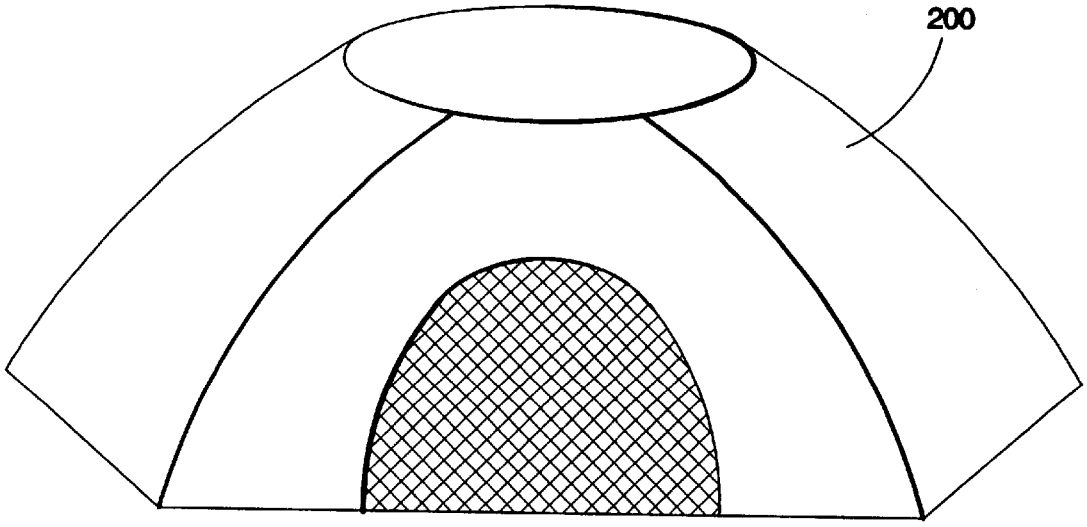
FIG. 6 is an isometric erected view of a typical tent such as is normally stored in the rear pocket of the combination jacket.

FIGS. 1 and 2 show the front of the preferred embodiment of the combination jacket/backpack in jacket form, FIGS. 3–5 show the back of the preferred embodiment and particularly illustrate the pocket particularly designed for storing a tent and accompanying tenting provisions, FIGS. 5–6 show the fully erected tent and reflective signal flag or marker, and FIGS. 8–14 illustrate the steps in converting the article of clothing from jacket form to backpack form and vice versa.

FIG. 1 is a front view of the preferred embodiment of the combination jacket/backpack 10 of the invention in jacket form. Jacket 10 is comprised of front panels 14 and 16, back panel 26, sleeves 36 and 38, collar 40, and has an open bottom. Front panels 14 and 16 have outer sides 18 and 20 and inner sides 22 and 24, while back panel 26 has an inner side 28 and an outer side 30. Preferably, jacket 10 is made from a nylon material such as Taslan Supplex Nylon having a polyurethane coating, although other suitable materials such as Gortex(™) or other lightweight material which is wind and weather resistant may be used. A lining to provide warmth, such as woven natural or synthetic fibers, goose down, or other insulative materials is also preferably provided. However, the article can be made in any conventional style as desired. There is preferably a thin wear and waterproof inside covering for the jacket which when the jacket is turned or converted into a backpack serves as the outer covering of such pack. Situated on the outer sides 18 and 20 of front panels 14 and 16 are a plurality of pockets 42, 44, 46, and 48, preferably made from a nylon mesh material of a known type and having flaps secured by Velcro®. In addition, zippered pockets 50 and 52 are located on the front panels 18 and 20 as shown. Additional pockets 54 and 56 are located on the lower area of sleeves 36 and 38, and which pockets are particularly designed for holding or storing right and left gloves 58 and 60, which gloves may be detachably secured to the sleeves by lines 62 and 64, respectively. Further, pockets 68 and 70 are located on the upper arm area of sleeves 36 and 38 and are preferably large enough to hold emergency blankets made from a tinfoil material, but could also be used to store other provisions. More or less pockets may also be added to the jacket as desired. Sleeves 36 and 38 are secured or tightened around the wrist area using adjustable Velcro® fasteners 76 and 78. Preferably, attached to the right Velcro® fastener is wristwatch 80, and attached to the left Velcro® fastener is compass 82. A reversible zipper 88, shown in FIG. 1A, is used to close the front panels 14 and 16 of the jacket in the normal manner. For reasons which will become evident, it is preferable that the zipper or closure be reversible so that the front panels can be more easily secured or zipped when converting the article from jacket form to backpack form, which in the preferred embodiment requires turning the jacket inside-out. A substantial nylon drawstring or cord 89 extends in channel 92, best shown in FIG. 2, around the lower periphery of the jacket 10. Such drawstring 89 allows the wearer to adjust the snugness of the jacket around his or her waist, thereby preventing unwanted elements such as wind, snow, rain and cold from entering the jacket through the bottom. Drawstring cord locks or clamps 90 are used to secure the length of the drawstring 89 at a desired position. In addition, as will be shown, in converting jacket 10 to backpack form, drawstring 89 will be pulled and locked as compactly or tightly as possible, in effect essentially closing off the bottom of the jacket 10.

FIG. 2 shows the jacket 10 with the front panels 14 and 16 opened to illustrate the inner sides 22 and 24 of the front panels as well as the inner side 28 of the back panel 26. In particular, FIG. 2 shows padded adjustable shoulder harness straps 112 and 114 as well as padded adjustable belt 116 having sections 116*a* and 166*b*, which are attached to the back panel 26. Such straps 112 and 114 and belt 116 act as both the supports for the tent 200 when it is being carried in pocket 170 in jacket form, shown in FIGS. 5 and 6, as well as the shoulder and waist straps for the backpack when the garment has been folded or converted into backpack form, shown in FIGS. 12 and 14. Such straps and belt are of a type well known and understood by those of ordinary skill in the art for use on backpacks and the like. When the combination garment is in jacket form, the straps and belt prevent the weight of the tent 200 from weighing or pulling down the back of the jacket, and in addition evenly distribute the weight of the tent or backpack across the article. Additional strap 118 may be provided to secure straps 112 and 114 in position in relation to each other.

Figure 13:
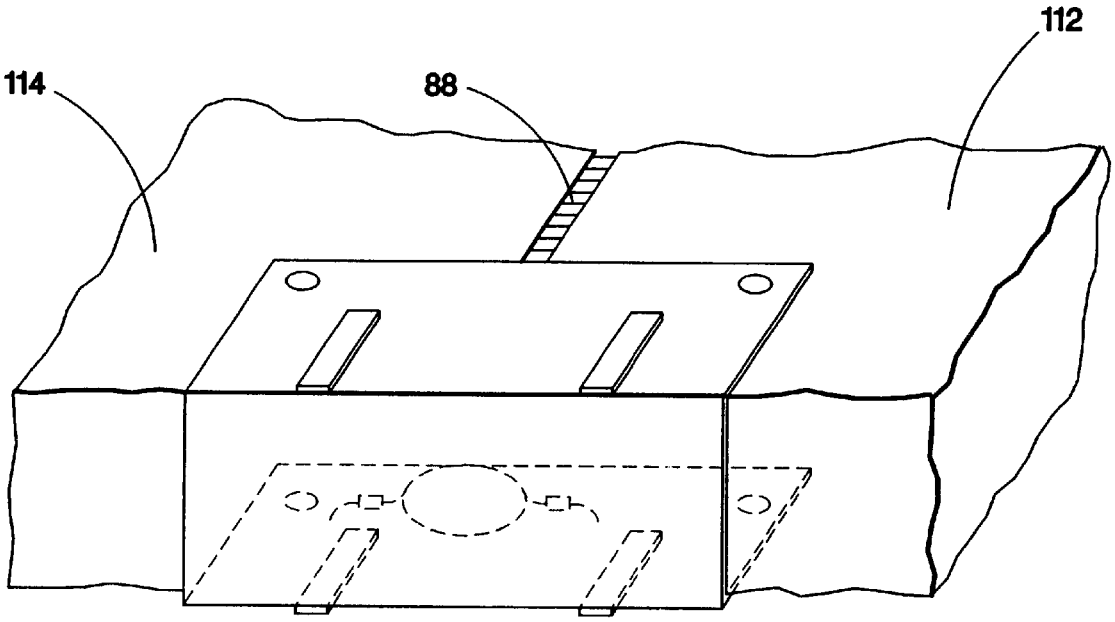
FIG. 13 is a close-up view of the bottom of the jacket as shown in FIG. 12.

Also secured to the inside 28 of the back panel 26 is flap or extra panel 130, which panel 130 is used to secure or cover the bottom of the backpack when used in backpack form. Preferably, panel 130 is detachably secured to the jacket 10 by snaps 132*a*, 132*b*, 132*c*, and 132*d* as well as Velcro® fasteners 133, although other suitable fasteners such as snaps and zippers may also be used. Panel 130 is preferably made from the same material as the outer shell of jacket 10, but may have a rubberized or other suitable durable coating on one side, which side acts as the bottom of the backpack as shown in FIG. 13 and discussed in more detail below.

FIG. 3 shows the back 26 of the jacket 10, wherein a pocket, generally designated as 160, for holding tent 200 is located. Hood pocket 134, shown zippered in FIG. 3, is located along the back of the collar 40, and is used to store hood 138, shown in a deployed position in FIG. 4. In addition, elastic straps 136 are positioned just below the collar 40 and may be used to carry various provisions, such as a sleeping bag, mat, or rolled up blanket as shown in FIG. 5. As shown in FIGS. 3 and 4, pocket 160 is concealed between outer panel 162 and the inner lining of the jacket. In order to access pocket 160, first outer panel 162, which is preferably secured to the jacket in the position shown in FIG. 3 by Velcro® type fasteners 168 around its periphery, is rolled up and tied by ties 164 and 166 as shown in FIG. 4. Outer panel 162 is preferably of the same material and color as the outer lining of the jacket 10, and serves the dual purposes of protecting the tent from the elements as well as concealing the pocket, thereby giving the jacket 10 a more attractive and fashionable appearance.

When the outer panel 162 is rolled up as shown in FIG. 4, reflective panel or cover 170 is revealed underneath, which panel has several purposes. First, reflective panel 170 acts as an attention attracting or signaling means. For example, if the jacket is worn with outer panel 162 rolled up as shown in FIG. 4, the brightly colored "X" 172 on reflective panel 170 will be visible to others, such as hunters if the jacket is being worn in a wooded area, or to cars if the jacket is being worn while riding a bicycle, walking along a highway at night or the like. Thus, panel 170 provides a safety function for the user. Second, as shown in FIGS. 4 and 5, panel 170 serves as a cover or front to the pocket 160. Zippers 176 and 178 situated along the sides of such panel 170 allow the pocket 160 to be opened as shown in FIG. 5. In addition, either a zipper or Velcro® attachment along the bottom edge 179 of the panel 170 allow such panel to be completely removed from the jacket. Mesh pockets 180 situated on the inner side 181 of the reflective panel are used to store tenting provisions 182, which include lightweight poles which form the frame of the tent, stakes for securing the tent in the ground, and the like. Tent 200 is packed in pocket 160 in as flat or compact a manner as possible. In order to store the tent in as flat a position as possible, preferably pocket 160 covers substantially the entire back panel 26 of the jacket 10. Although the tenting provisions 182 could also be simply placed in the pocket 160, having the tenting provisions 182 situated on top of the tent 200 in mesh pockets 180 on the back side of the reflective panel 170 allows the tent 200 to act as a barrier or cushion between such tenting provisions 182 and the wearer, thereby increasing the comfort of the jacket. FIG. 6 shows a typical tent 200. Rather than using a portion of the jacket 10 as part of the material for the tent, a completely separate tent is provided. While this requires slightly more material than some of the prior art arrangements, it also allows the wearer to continue using the garment either as a jacket or backpack without bringing the tent along. Thus, a wearer who is caught in an emergency situation will not be faced with the decision as to whether to deploy the tent or keep the jacket on since the tent is completely separate from the jacket.

Figure 7:
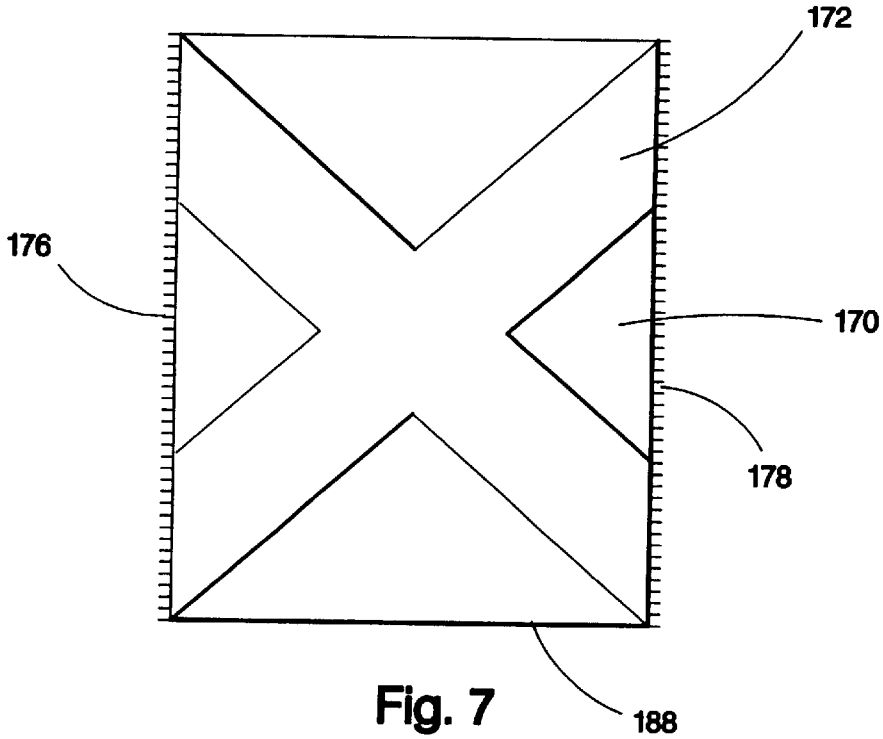

FIG. 7 shows a third use for the reflective panel 170, which is as a warning or signaling flag separate from the jacket 10. Such flag could be, for example, secured to a pole or tree to act as a marker or the like in the woods, or even in a crowded park or beach, to alert others to one's presence or location. As indicated above, while panel 170 is preferably secured to the jacket 10 by zippers 176 and 178 along its two side edges, the bottom edge 188 is preferably secured to the jacket by Velcro® type fasteners 179, although of course a zipper or other known attachment means such as buttons could also be used.

Figure 8:
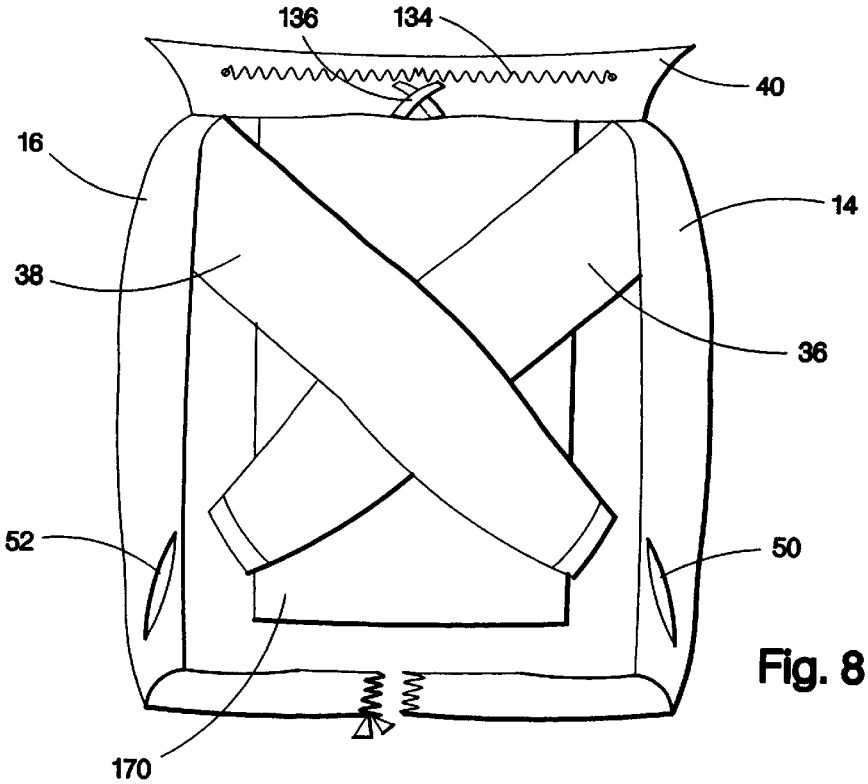
FIG. 8 is a partial view of the jacket with the arms folded over the back panel as the first step in converting the jacket into a backpack as shown in FIGS. 8–11.
Figure 9:
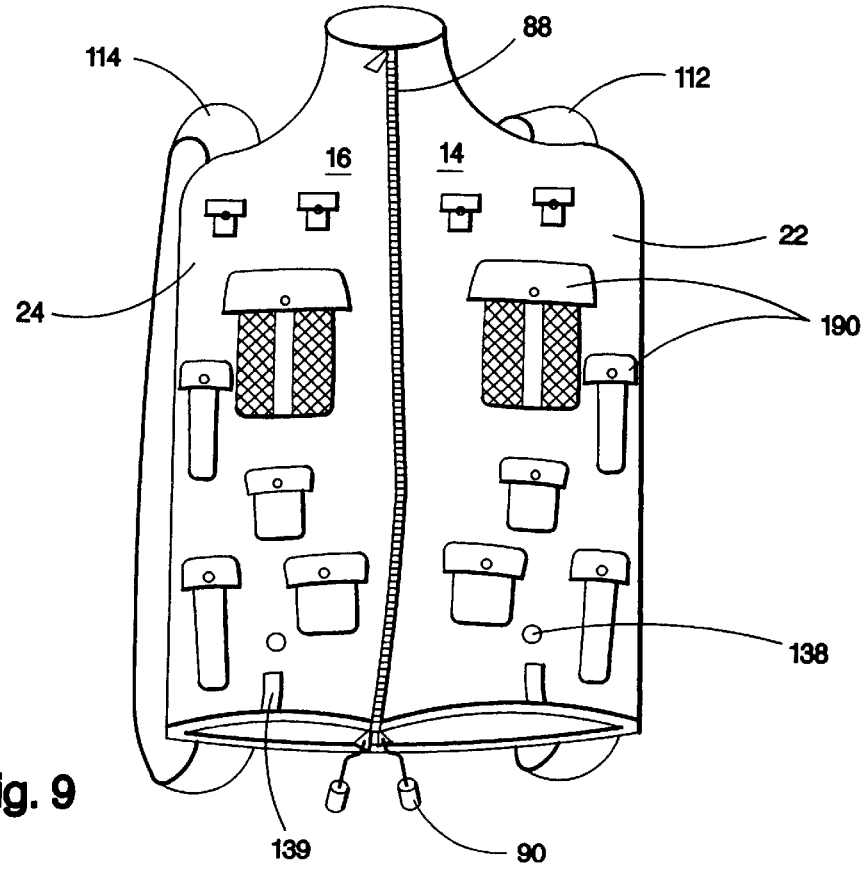
FIG. 9 is a view of the jacket folded inside out and zippered such that the inner sides of the front panels are now facing outwardly.

FIGS. 8–13 show the steps involved in converting the interconvertible article of clothing from a jacket or overcoat into a backpack or carrying bag. First, as shown in FIG. 8, the garment is laid face down with the outer side 30 of the back panel 26 facing up and with the front panels 14 and 16 disposed underneath and/or to the sides of back panel 26. Prior to folding, panel 162 should be untied and secured by Velcro® fastener 168. In addition, reflective panel 170 should be closed or zippered if it is being stored in the jacket at such time, and tent 200 may either be secured under panel 170 or removed from the garment, depending on whether the wearer desires to carry it at such time. Hood 138 should also be folded back into pocket 134 and zippered. If a blanket or sleeping bag is being carried in elastic straps 136, it should also be removed, and can be carried within the backpack as will be shown. Panel 130 may also be removed or unsnapped from the jacket. Next, sleeves 36 and 38 are neatly folded rearwardly across the outside 30 of back panel 26 across panel 170 as shown in FIG. 8. Sleeves 36 and 38 could also be rolled up or otherwise folded as long as they are maneuvered across the back 26 and stored as compactly or flatly as possible. After sleeves 36 and 38 have been so positioned, front panels 14 and 16 are then also folded rearwardly over the top of the sleeves as shown in FIG. 9 until such panels completely cover the sleeves. Outer sides 18 and 20 should now be disposed inwardly against sleeves 36 and 38 and inner sides 22 and 24 should now be facing outwardly. Reversible zipper 88 is then closed to hold or secure the panels together. At this point, the garment has essentially been zippered in an inside out orientation with sleeves 36 and 38 situated between the garment panels, creating a space between the panels 14,16 and 26 which can be used for storing or carrying various articles once the bottom is closed off by panel 130 as described below. FIG. 9 also shows a variety of differently shaped and sized pockets 190 which may be disposed on the inside surfaces 22 and 24 of the front panels 14 and 16, respectively. In addition, snaps 138 and Velcro® fasteners 139, which are used to secure flap 130, shown in FIG. 2, across the bottom of the backpack, are also now facing outwardly. Meanwhile, shoulder straps 112 and 114 and belt 116 are no longer covered by the front panels 14 and 16 and are essentially now on the outer side of the garment.

Figure 10:
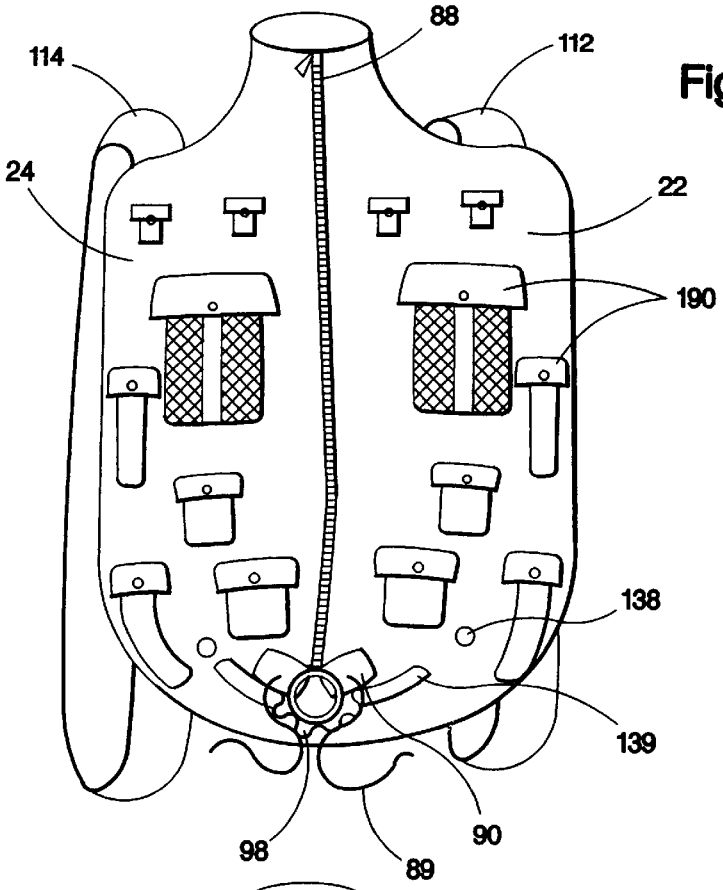
FIG. 10 is view of the jacket as shown in FIG. 9 with the draw string along the bottom periphery of jacket tightly pulled and secured by the cord locks.

Once the front panels have been closed by zipper 88 in an inside-out orientation, the next step is to close or secure the bottom of the jacket. In the preferred embodiment of the invention, this is done by first pulling the drawstring 89 as tightly as possible and then securing the drawstring 89 in such position by cord locks 90, as shown in FIGS. 10 and 11. Pulling the drawstring 89 as tightly as possible causes the panels 14, 16 and 26 of the garment to be pulled together, thereby substantially closing off and creating a bottom surface 94 for the backpack or carrying bag.

Figure 12:
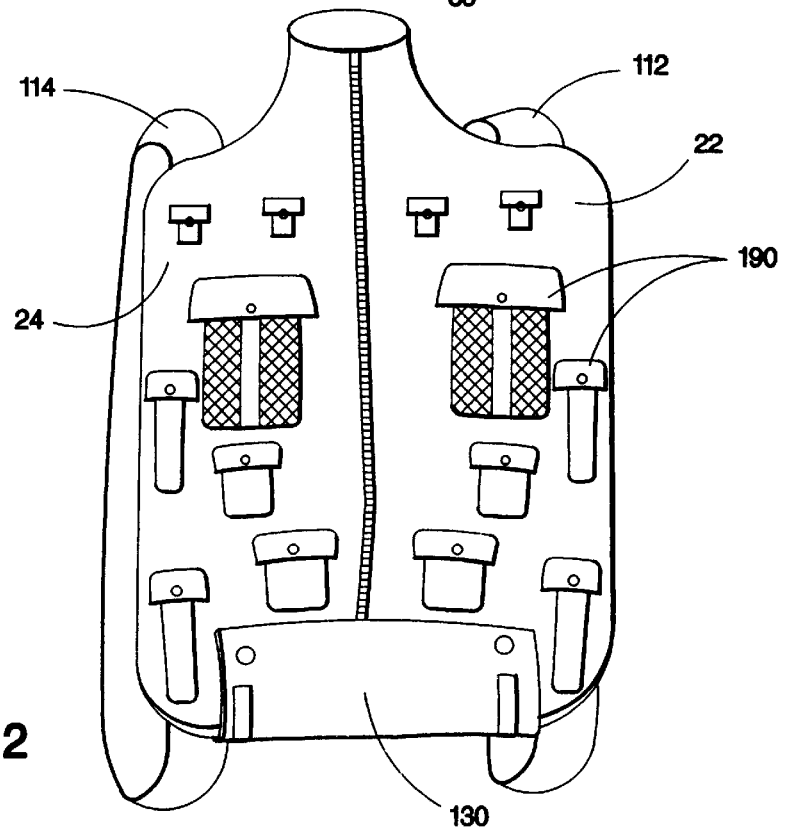
FIG. 12 is a view of the jacket as shown in FIG. 9 and 10 with the flap visible in FIG. 2 secured around the bottom of the jacket and attached to the front panels.

FIG. 11 shows a closer view of the drawstring 89 pulled tightly as shown in FIG. 10 and with the locks 90 securing the drawstring 89 in such position. While most of the bottom surface 94 is now closed, a small hole or aperture 98 remains unclosed. This results from the bunching up of the garment material of the panels 14, 16, and 26, which although compacted by the tightening of drawstring 89, cannot be compacted tightly enough to entirely close off such hole 98. Thus, while the garment can now be used as a backpack for carrying large items such as the tent 200, blanket, a sleeping bag, or other provisions, smaller items such as change, small batteries and the like could slip through the hole 98 and be lost if stored in the backpack in its present form. Although the bottom could be folded to cover such hole, this would decrease the amount of usable space between the panels. Thus, rather than further folding the article, the inventor has provided an alternate means for closing off or covering the hole 98 in the form of an additional flap or panel 130, shown attached to the inner side 28 of the back panel 26 in FIG. 2. Flap 130 is secured over substantially the entire central portion, including hole 98, of the bottom surface 94. To apply flap 130 over the bottom surface 94, first the flap is removed from the inner side of the back panel 28, to which it is secured both by snaps 132*a*–*d* and Velcro® fasteners 133, or other suitable fastening means. Next, the flap is fitted longitudinally over hole 98 across the bottom surface 94 as shown in FIGS. 12 and 13. Snaps 132*a* and 132*b* may be attached on back panel 26 to snaps 138, snap 132*c* is snapped to the front panel 24 and snap 132*d* is snapped to front panel 22. In addition, Velcro® fasteners 139 are connected to provide additional support for the flap 130. Alternatively, flap 130 can be constructed so that it is only partially removed from the inner side 26 of the back panel 28 and is draped or flapped over bottom surface 94 and connected to the front panels as described above.

Once the flap 130 has been attached over the bottom surface 94, the backpack can be filled through the opening around the collar area 40. Collar 40 can be closed by a drawstring or cord and secured by a cord lock, not shown, although this is not thought to be necessary in all cases since it is unlikely that items would be able to fall out of such small opening. When it is desired to convert the article from backpack form to jacket form, the above steps should generally be reversed. First, any articles being carried in the backpack should be removed. Next, flap 130 should be detached from the bottom surface 94, and locks 90 unlocked to allow drawstring 89 to be loosened. Panels 14 and 16 are then unzipped and swung around so that they are again positioned over the front of the jacket. Finally, sleeves 36 and 38 may be unfolded, at which time the jacket may be placed of the torso of the wearer and put on in the normal manner.

Thus, the present inventor has provided a more versatile interconvertible article of clothing than is known in the prior art, which article may be quickly and easily converted from a jacket form to a backpack form and vice versa. Such jacket is preferably suitable both for hiking and extended outdoor adventures as well as for more normal everyday uses. In addition, a large storage compartment is provided in the back panel of the article which is specifically designed to more comfortably accommodate a tent as well as a variety of required tenting provisions such as the tent poles and ground stakes, which are housed in pockets on the outer surface of the pocket cover such that the tent itself provides a cushion between such provisions and the body of the person wearing the jacket. Providing a full size tent separate from the jacket allows a user to continue wearing the jacket while the tent is in use, thereby providing additional warmth and protection to the user. A safety or signalling flag is also provided under the outer shell on the back of the jacket which can either be used on the jacket or separately from the jacket as required. Pairs of special pockets on the sleeves of the jacket are provided for storing gloves or mittens and thermofoil blankets, respectively. In addition, a plurality of different sized and shaped pockets are provided on the inner and outer panels of the jacket for carrying other survival required survival equipment or, alternatively, a wallet or keys if the jacket is used in everyday use.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A garment convertible into a backpack and vice versa comprising:

a body portion worn as a jacket having outer and inner front and back panels, a storage compartment dimensioned to encompass a tent, said compartment being accessible from the outer side of the back panel of said garment, a pair of shoulder straps secured to the inside surface of the back panel of the garment comprising a pair of loop structures are placed over the shoulders and under the arms of a user when the garment is worn, said straps being secured to said surface of the garment at points which provide support for the tent when stored in the storage compartment when the jacket is worn and for supporting a load when the garment is worn as a backpack; and a detachable panel forms at least a portion of the bottom or base of the backpack upon the garment being converted to use as a backpack, said panel being at least partially unfastened from its position when the garment is worn as a garment and fastened across the bottom of the garment when converted to a backpack.

2. A garment in accordance with claim 1 wherein a portion of the back panel is detachably connected to the garment.

3. A garment in accordance with claim 2 wherein a panel containing a reflective coating on at least one side is positioned under that portion of the back panel which is detachable.

4. A garment in accordance with claim 3 wherein said reflective panel is detachable from the garment.

5. A garment in accordance with claim 3 wherein the reflective panel contains storage compartments on one side.

6. A garment in accordance with claim 1 wherein a plurality of pockets are situated on the panels of the jacket.

7. A garment in accordance with claim 1 additionally comprising sleeves, each sleeve containing a hook and loop fastening means around the wrist area.

8. A garment in accordance with claim 7 additionally comprising a wristwatch attached to one of said hook and loop fastening means.

9. A garment in accordance with claim 7 additionally comprising a compass attached to one of said hook and loop fastening means.

10. A garment in accordance with claim 1 wherein said fastening means is a reversible zipper.

11. A garment comprising:

(a) a jacket having a jacket front panel, a jacket rear panel, and a pair of sleeves, said jacket front panel having a fastening means for opening and closing said jacket;

(b) said jacket front panel and jacket rear panel each having an inner surface and an outer surface;

(c) a large storage compartment situated between the inner surface and outer surface of the jacket rear panel, said storage compartment dimensioned to extend within a major portion of the rear panel;

(d) a pair of shoulder straps and a waist belt attached to the inner surface of the jacket rear panel;

(e) an opening in the outer surface of the jacket rear panel for accessing said storage compartment;

(f) a detachable storage compartment cover having an innermost surface and an outermost surface, said outermost surface containing a reflective coating;

(g) a plurality of pockets attached to the innermost surface of said storage compartment cover designed for holding tenting provisions; and (h) means for closing the front and back panels around the bottom periphery of said panels; and (i) whereby said jacket is alternatively convertible into a backpack.

12. A jacket in accordance with claim 11 additionally comprising a plurality of pockets located on the inner and outer surfaces of said jacket front panel.

13. A garment in accordance with claim 12 wherein said fastening means is double sided or reversible.

14. A garment in accordance with claim 11 additionally comprising a third jacket panel having an outside surface and inside surface, said panel detachably secured to the inner surface of said jacket back panel.

15. A garment in accordance with claim 14 wherein the outside surface of said third jacket panel contains a rubberized or wear resistant coating.

16. A garment in accordance with claim 14 wherein the inside surface of said third jacket panel may be simultaneously attached to the outer surfaces of said jacket front panel and jacket rear panel, thereby creating a bottom for said garment when in backpack form.

17. A method for converting an upper torso encompassing garment into a backpack or carrying bag and vice versa, said garment having front and rear panels, aims, a reversible zipper, a drawstring at the bottom and a lower flap extendible from the back panel comprising the steps of:

(a) folding the arms of the garment across the back panel of the garment;

(b) folding the front panels of the garment over the arms on the back panel such that the inside surface of the front panels is facing outwardly on top of the back panel;

(c) zipping the front panels together using the reversible zipper;

(d) closing the drawstring located along the periphery of the bottom of the garment; and (e) detaching the flap located on the inside back panel of the garment and reattaching it around the bottom of the garment and onto the inside face of the front panels using already provided attachment means on the flap and front panels.

18. An outdoor survival garment comprising:

a jacket member covering the upper torso of a user having shoulder portions, arm openings through said shoulder portions, and a neck opening, and having front and back panels, a storage compartment dimensioned to encompass a portable shelter, said compartment being accessible from the outer side of the back panel of said garment, and a panel containing a reflective coating on at least one side positioned under the back panel, said reflective panel being detachable from the jacket member.

19. The outdoor survival garment of claim 18 wherein said jacket member is convertible into a backpack.

20. The outdoor survival garment of claim 19 additionally comprising a panel detachably secured to the garment adapted to form at least a portion of the bottom or base of the backpack upon the jacket member being converted to use as a backpack by temporary attachment across the bottom of the backpack.

* * * * *